United States Patent [19]

Hoshii

[11] Patent Number: 4,478,123

[45] Date of Patent: Oct. 23, 1984

[54] ELECTRONIC EQUIPMENT WITH TONE GENERATING FUNCTION

[75] Inventor: Toshifumi Hoshii, Tokyo, Japan

[73] Assignee: Casio Computer Co., Ltd., Tokyo, Japan

[21] Appl. No.: 534,396

[22] Filed: Sep. 22, 1983

Related U.S. Application Data

[63] Continuation of Ser. No. 330,009, Dec. 11, 1981, abandoned.

[30] Foreign Application Priority Data

Dec. 23, 1980 [JP] Japan ..... 55-181352

[51] Int. Cl.[3] ..... G10H 1/42; G10H 7/00

[52] U.S. Cl. ..... 84/1.03; 84/DIG. 12

[58] Field of Search ..... 84/1.03, DIG. 12

[56] References Cited

U.S. PATENT DOCUMENTS

| | | | |
|---|---|---|---|
| 4,218,949 | 8/1980 | Schwartz et al. . | |
| 4,226,155 | 10/1980 | Ferdinand | 84/1.03 |
| 4,297,934 | 11/1981 | Imamura et al. | 84/1.03 |
| 4,326,276 | 4/1982 | Scott, Jr. | 84/1.03 X |
| 4,326,441 | 4/1982 | Imamura et al. | 84/1.03 |
| 4,344,345 | 8/1982 | Sano | 84/1.03 |

FOREIGN PATENT DOCUMENTS

| | | |
|---|---|---|
| 2029582 | 12/1971 | Fed. Rep. of Germany . |
| 2728513 | 1/1978 | Fed. Rep. of Germany . |
| 2508509 | 8/1979 | Fed. Rep. of Germany . |
| 2852271 | 6/1980 | Fed. Rep. of Germany . |
| 2808285 | 9/1980 | Fed. Rep. of Germany . |
| 2510993 | 12/1980 | Fed. Rep. of Germany . |

*Primary Examiner*—S. J. Witkowski

*Attorney, Agent, or Firm*—Frishauf, Holtz, Goodman & Woodward

[57] ABSTRACT

Electronic equipment having a tone generating function has a memory which stores rhythm patterns. Rhythm pattern data which is stored in the memory is sequentially read out by key-in operation at a key input section which selects a desired rhythm pattern. The number of depressing operations by a tempo setting key at the key input section is counted at a counter. The rhythm pattern data which is read out from the memory is set in a predetermined pattern. A control circuit controls the readout speed of the rhythm pattern data in accordance with the counting value of the counter.

5 Claims, 16 Drawing Figures

FIG. 3

| | 0 | 1 | 2 | 3 | 4 | 5 | 6 | 7 | 8 | 9 |
|---|---|---|---|---|---|---|---|---|---|---|
| 0 | 1 | 1 | 1 | 2 | 1 | 1 | 2 | 2 | 2 | 1 |
| 1 | | | | | | | | | | |
| 2 | | | | | | | 3 | 3 | 3 | |
| 3 | | | | | | | | | 3 | |
| 4 | | | | | 2 | 2 | 3 | 2 | 3 | 3 |
| 5 | | | | | | | | | | |
| 6 | | | | | | | 2 | 3 | 2 | 3 |
| 7 | | | | | | | | | | |
| 8 | 3 | 3 | 3 | 3 | 3 | 3 | 1 | 1 | 3 | 3 |
| 9 | | | | | | | | | | |
| 10 | | | | | | | 3 | 1 | 3 | |
| 11 | | | | | | | | | | |
| 12 | | | | | 3 | 2 | 2 | 3 | 2 | 3 |
| 13 | | | | | | | | | | |
| 14 | | | | 2 | | 1 | 3 | 2 | 3 | |
| 15 | | | | | | | | | | |
| 16 | 1 | 3 | 3 | 2 | 1 | 1 | 1 | 3 | 3 | 2 |
| 17 | | | | | | | | | | |
| 18 | | | | | | | 3 | 2 | 3 | |
| 19 | | | | | | | | | 3 | |
| 20 | | | | | 2 | 1 | 2 | 3 | 2 | 3 |
| 21 | | | | | | | | | | |
| 22 | | | | | | | 1 | 2 | 3 | |
| 23 | | | | | | | | | | |
| 24 | 3 | | 3 | 3 | 3 | 3 | 1 | 1 | 2 | 1 |
| 25 | | | | | | | | | | |
| 26 | | | | | | | 2 | 1 | 3 | |
| 27 | | | | | | | | | | |
| 28 | | | | | 2 | 2 | 3 | 1 | 1 | 3 |
| 29 | | | | | | | | | | |
| 30 | | | | 2 | | | 1 | 3 | 1 | |
| 31 | | | | | | | | | | |

FIG. 5

| KEY | CONTROL COUNTER 16 | DISPLAY | TIME (ms) |
|---|---|---|---|
| | 6 | [ 9 ] | 7.5 X 6 X8 = 360 |
| | 7 | [ 8 ] | 7.5 X 7 X8 = 420 |
| | 8 | [ 7 ] | 7.5 X 8 X8 = 480 |
| | 9 | [ 6 ] | 7.5 X 9 X8 = 540 |
| | 10 | [ 5 ] | 7.5 X10 X8 = 600 |
| | 11 | [ 4 ] | 7.5 X11 X8 = 660 |
| | 12 | [ 3 ] | 7.5 X12 X8 = 720 |
| | 13 | [ 2 ] | 7.5 X13 X8 = 780 |
| √ FAST | 14 | [ 1 ] | 7.5 X14 X8 = 840 |
| | 15 | [ 0 ] | 7.5 X15 X8 = 900 |
| % SLOW | 16 | [ − 1 ] | 7.5 X16 X8 = 960 |
| | 17 | [ − 2 ] | 7.5 X17 X8 = 1020 |
| | 18 | [ − 3 ] | 7.5 X18 X8 = 1080 |
| | 19 | [ − 4 ] | 7.5 X19 X8 = 1140 |
| | 20 | [ − 5 ] | 7.5 X20 X8 = 1200 |
| | 21 | [ − 6 ] | 7.5 X21 X8 = 1260 |
| | 22 | [ − 7 ] | 7.5 X22 X8 = 1320 |
| | 23 | [ − 8 ] | 7.5 X23 X8 = 1380 |
| | 24 | [ − 9 ] | 7.5 X24 X8 = 1440 |

ELECTRONIC EQUIPMENT WITH TONE GENERATING FUNCTION

This application is a continuation of Ser. No. 330,009 filed Dec. 11, 1981 now abandoned.

BACKGROUND OF THE INVENTION

The present invention relates to electronic equipment with a tone generating function in which rhythm pattern data is read out from a memory means and rhythm performance is accomplished.

In general, an automatic rhythm accompaniment unit is arranged with an electronic musical instrument. A rhythmic tempo is controlled by, for example, a rotary dial operation. In this conventional manner, a mechanically operated dial is used to control the rhythmic tempo, so that a considerably large built-in space and a large number of component parts are required.

SUMMARY OF THE INVENTION

It is an object of the present invention to eliminate the drawbacks as described above and to provide an electronic musical instrument with a tone generating function which does not require excessive built-in space for a mechanically operated dial or the like and which reduces the number of component parts.

In order to achieve the above and other objects of the present invention, there is provided an electronic musical instrument with a tone generating function which comprises memory means for storing rhythm pattern data; readout means for sequentially reading out the rhythm pattern data which is stored in said memory means, in accordance with an instruction made by a rhythm selecting key which selects a desired rhythm pattern; counting means for counting the number of counting operations of a tempo setting key in order to arbitrarily set a tempo of the rhythm pattern data which is read out from said readout means; and control means for controlling a readout speed of the rhythm pattern data which is read out from said readout means in accordance with a counted value of said counting means.

With the above arrangement, the rhythmic tempo is controlled by the number of key-in operations of external control keys. Therefore, excessive built-in space is not required and the number of component parts is reduced.

BRIEF DESCRIPTION OF THE DRAWINGS

FIG. 3 is a view for explaining the detailed arrangement of a ROM 25 of FIG. 2;

FIG. 5 is a table for explaining the relations among key-in operations of [√] and [%] keys which are used for changing rhythmic tempos, counting values of a control counter 16, display contents at a display section 3, and durations of rhythm sounds;

DETAILED DESCRIPTION OF THE PREFERRED EMBODIMENTS

Figure 1:
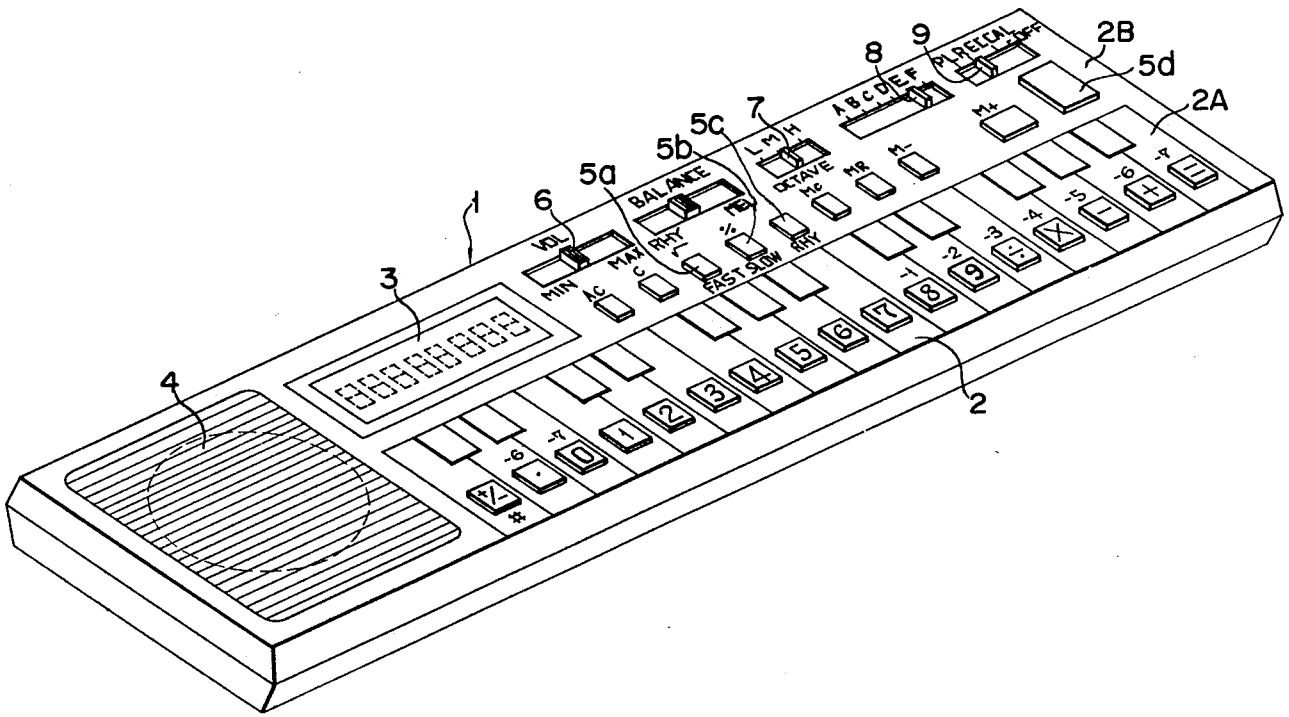
FIG. 1 is a perspective view of the outer appearance of an electronic portable calculator which is used as an electronic musical instrument according to one embodiment of the present invention.
Figure 7:
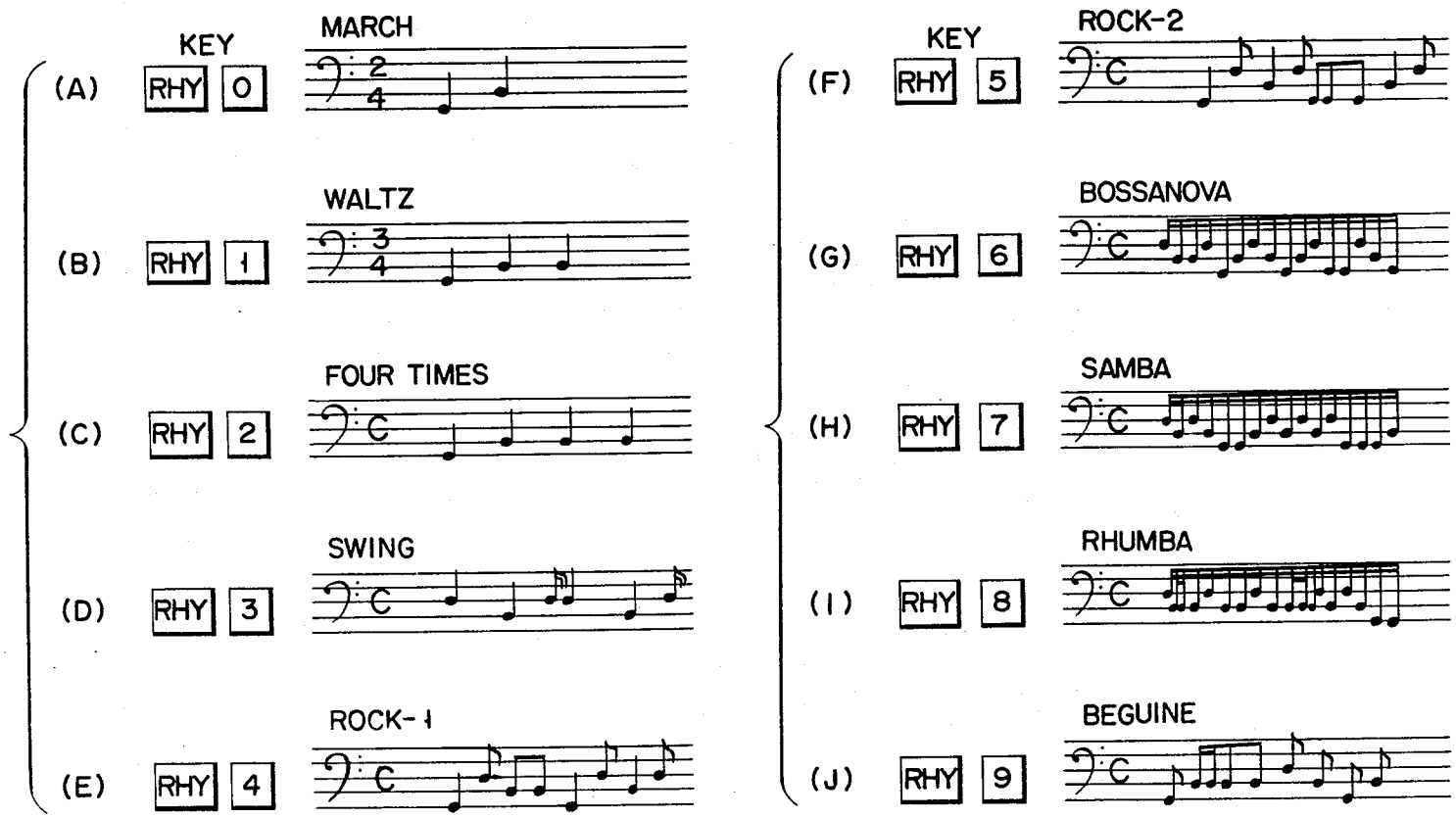
FIGS. 7A to 7J are views for explaining the relations among 10 kinds of rhythm patterns and mode designation operations thereof.

One embodiment of the present invention which is applied to an electronic portable calculator with a tone generating function will be described with reference to the accompanying drawings. Referring to FIG. 1, a key input section 2 with various keys, a display section 3 and a sound producing section 4 are arranged on a case 1 of the electronic portable calculator. An LSI (Large Scale Integration device) 10 as indicated by an alternate long and short dashed line in FIG. 2, a battery and the like are disposed within the case 1. Keys which are used for calculation of the electronic portable calculator and keys which are used for performing a melody are arranged in the key input section 2. In particular, ten keys [0] to [9] and various function keys [÷], [×], . . . , [=], [AC], and [M+] are used for calculation. Seventeen keys on a keyboard 2A of the key input section 2, such as keys [+/−], [.], . . . and [=] are utilized for pitch designation keys of pitches A3 to B5 besides the original functions. A [√] key 5*a* and a [%] key 5*b* are respectively utilized as tempo keys which, besides their original functions, respectively, increase and decrease the tempo level by one level. Further, [RHY] key 5*c* together with the ten keys [0] to [9] is used as a rhythm designation key which selects one among the ten kinds of rhythm patterns (FIG. 7). [MC], [MR], [M−], and [M+] keys, are respectively, utilized for melody read-in and readout keys besides their original functions. Reference numeral 5*d* denotes a one-key play key; 6, a volume switch; 7, an octave shift switch; 8, a timbre designation switch; and 9, a mode changeover switch. The one-key play key 5*d* is for reading out pitch data for one note of a melody, which is preset in a memory 17 to be described later, and performs this melody. The octave shift switch 7 shifts one octave for notes A3 to B5 upward or downward. The timbre designation switch 8 has changeover positions A to E and F. At the positions A to E, five kinds of timbre such as piano and the like are specified. At the position F, data is input for setting time for ADSR, and timbre in the one-key play or the like. Further, the mode changeover switch 9 has changeover positions PL, REC, CAL, and OFF. The position PL designates the play mode, the position REC designates the recording mode, the position CAL designates the calculation mode, and the position OFF designates the power-off mode.

Among the seventeen pitch designation keys, the [+/−] key is a semitone key, the [.] and [0] keys designate pitches A and B of the third octave, the [1] to [7] keys designate pitches C to B of the fourth octave, and the 11[8] to [=] keys designate pitches C to B of the fifth octave. When the semitone key is depressed, for example, when the pitch A3# is to be produced, the sequential key-in operation of the [+/−] and [.] keys must be performed. A keyboard pattern is printed on the keyboard 2A in order to indicate that the [+/−] to [=] keys, respectively, correspond to the musical scale as described above. Further, the pitches C to B correspond to numbers 1 to 7 in the keyboard 2A. In the third octave, a bar (—) is marked at the lower left corner of the numbers. The numbers 1 to 7 which correspond to the notes of the fourth octave are not marked with the bar. Numbers which correspond to the notes of the fifth octave are marked with the bar at the upper left corner in the keyboard 2A.

The display section 3 comprises a liquid crystal display section in which eight characters are displayed for numbers, notes and rhythmic tempos.

Figure 2:
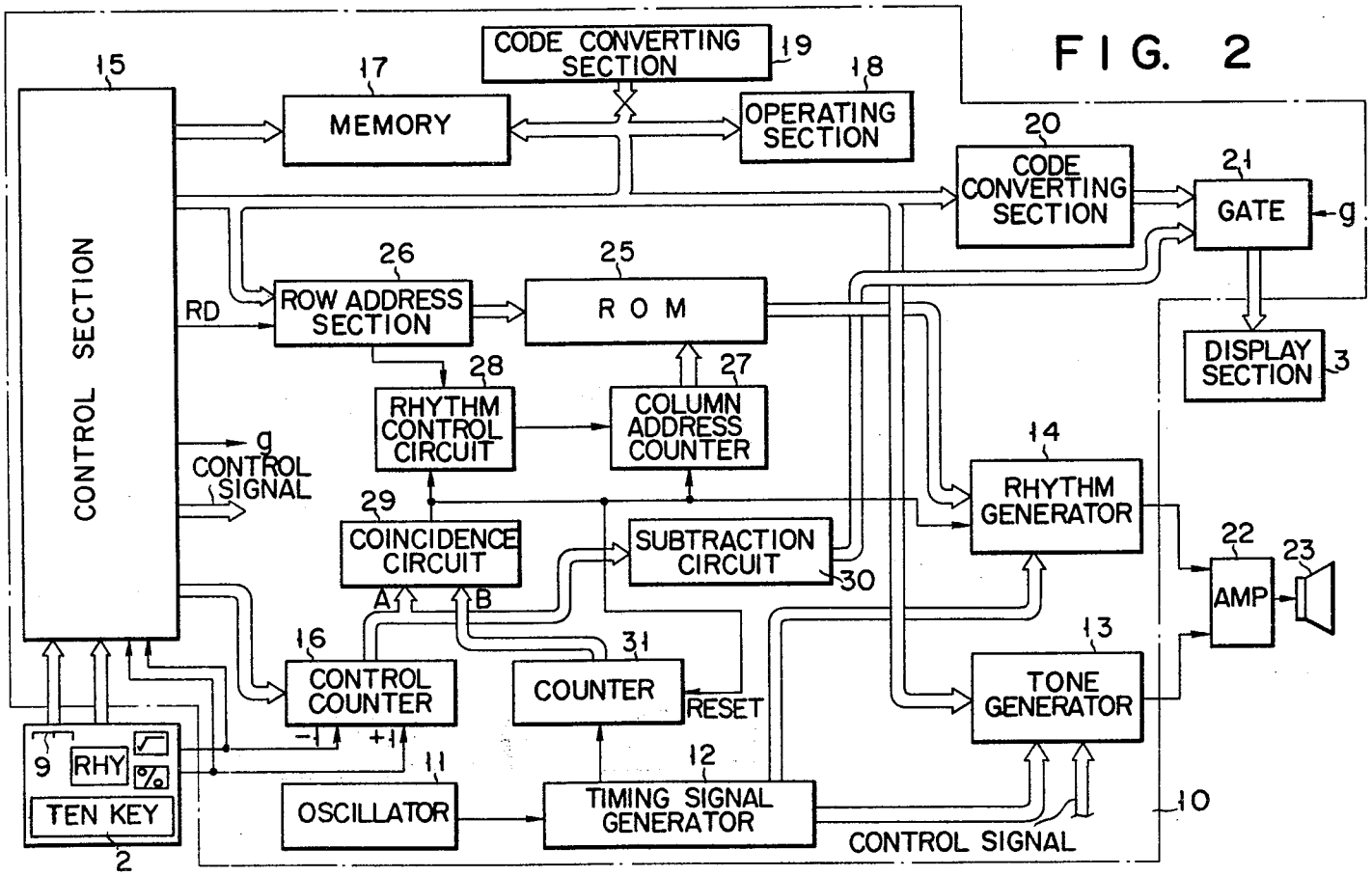
FIG. 2 is a circuit diagram of the electronic musical instrument according to the embodiment of the present invention.
Figure 4:
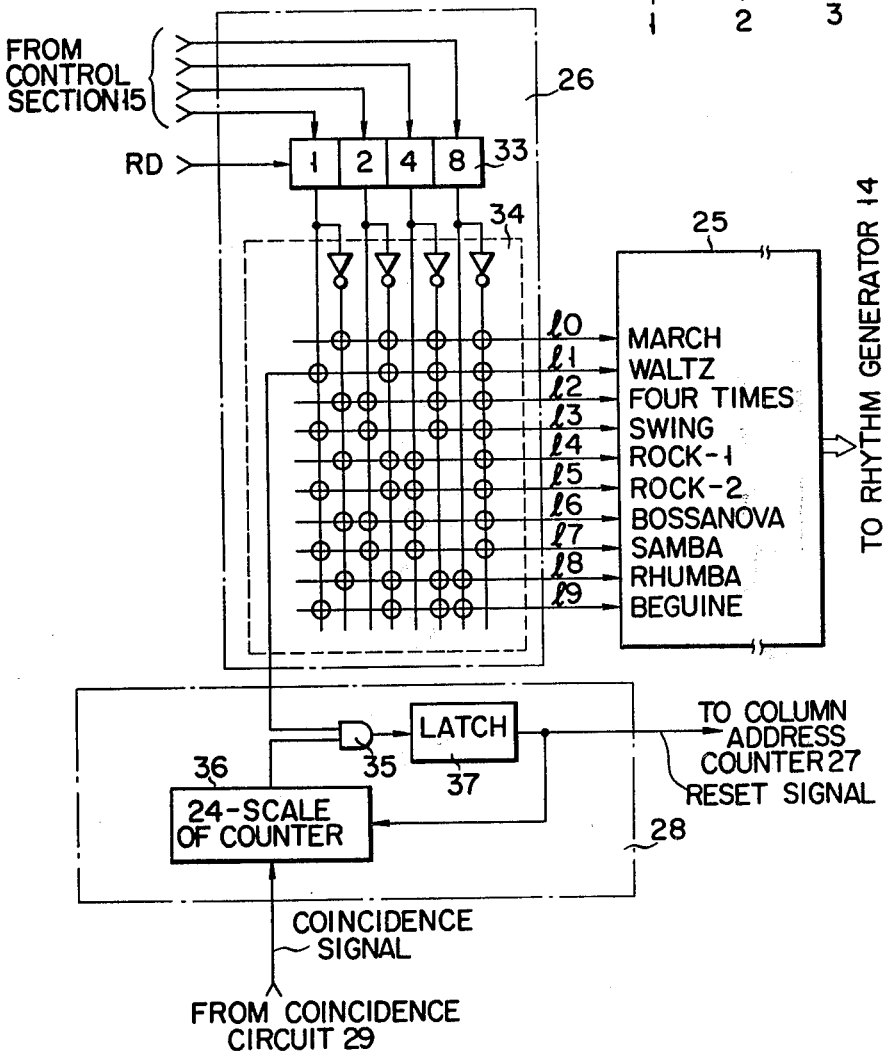
FIG. 4 is a detailed circuit diagram of a row address section 26 and a rhythm control circuit 28 of FIG. 2.

The circuit diagram of the electronic portable musical instrument with a tone generating function will be described with reference to FIGS. 2 to 4. An oscillator 11 constantly oscillates to output signals having a predetermined frequency. The oscillation signal is supplied to a timing signal generator 12. The oscillation signal is frequency-divided at the timing signal generator 12. The divided signals are supplied to a tone generator 13 as clock signals having frequencies of 50 kHz, 100 kHz and 200 kHz, to a rhythm generator 14 as clock signals having frequencies of 1.5 kHz, 780 kHz, 390 kHz, 96 Hz, and 48 Hz, and to other circuits of FIG. 2 as various timing signals.

A key control signal which is supplied from the key input section 2 is supplied to a control section 15. A key control signal from the √ key 5*a* is supplied to a control counter 16 as a unitary incrementing signal, and a key control signal from the % key 5*b* is supplied to the control counter 16 as a unitary decrementing signal so that the counting value of the control counter 16 is increased by +1 and decreased by −1. The control section 15 stores microprograms which control operations in various modes of the electronic portable calculator. In the calculation and melody performance modes, when each key control signal is supplied to the control section 15, the control section 15 identifies the key from which that key control signal is transmitted and outputs a microinstruction in response to the signal. In the calculation mode, when the ten keys are depressed, numeric data corresponding to the depressed keys is outputted and stored in an operating register of the memory 17. When one of the function keys is depressed, the corresponding instruction signal is outputted. The numeric data which is stored in the operating register is transferred to an operating section 18 in which a proper operation is performed, accomplishing four arithmetic operations or the like. Further, in the recording mode, the [+/−] to [=] keys are depressed to perform a melody so that the control section 15 writes codes 1 to 27 which designate pitches corresponding to the respective key control signals in predetermined areas within the memory 17. The codes 1 to 27, respectively, correspond to pitches of the notes A3 to B5. The pitch data (data which is represeted by one of the codes 1 to 27) which is written in the predetermined area in the memory 17 is sequentially read out evey time the one-key play key 5*d* is depressed in the play mode, accomplishing one-key playing. Further, in the play mode, the melody performance with the pitch designation keys is performed with rhythmic accompaniment under the control of the control section 15.

The memory 17 comprises a RAM (random access memory) which has X, Y, Z, F and M registers of 16 bits. The X, Y and Z registers are used for calculation and are mainly used in the calculation mode. First, second and third area areas F0, F1 and F2 of the F register store a note code (binary coded signal) to be described later. The M register stores data such as an attack of an envelope. This data is input when the timbre designation switch 8 is set in the lower position and the ten keys are depressed. The X register is utilized as a display register, besides its original function, so that data in the X register is supplied to the display section 3 to be displayed there.

The operating section 18 performs the four arithmetic operations and other judging operations in each mode. In this case, data for arithmetic operations is supplied from the various registers in the memory 17 and the control section. The operated results are stored in a specified register in the memory 17. The judged results in the judging operation are supplied to the control section 15 so that these results are used for producing a subsequent microinstruction.

A code converting section 19 is a circuit which writes, in the first to third areas F0 to F2 of the F register, the note code which is converted from the corresponding code among the codes 1 to 27 which are stored in first and second areas X0 and X1 of the X register. In this case, as described above, the codes 1 to 27, respectively, correspond to the pitches A3 to B5. Therefore, the codes 1 to 27 have a predetermined relation with the note codes, so that a tone whose pitch corresponds to the specific note code is produced at the tone generator 13. In both recording and play modes, when a pitch designation key is depressed, codes corresponding to the first and second areas X0 and X1 of the X register are written therein under the control of the control section 15. In the recording mode, the codes which are written in the first and second areas X0 and X1 of the X register are further transferred to and stored in predetermined areas of the memory 17. Further, the codes which are stored in the predetermined areas in the memory 17 or in the first and second areas X0 and X1 of the X register are converted to the corresponding note codes by the code coverting section 19 and are written in the first to third areas F0 to F2 of the F register when the melody performance is accomplished. The codes which are stored in the first to third areas F0 to F2 of the F register are sequentially transferred to the tone generator 13 and are utilized for generating tones as described above.

A code converting section 20 converts the codes 1 to 27 to corresponding display data in the recording and play modes and supplies the display data to the display section 3 through a gate 21. Therefore, the key-in operation and the pitch of the pitch data are visually checked at the display section 3. In this case, as described above, the pitches C to B correspond to the numbers 1 to 7, so that the pitches C to B are displayed as the numbers 1 to 7, respectively. Further, semitones are displayed by the numbers accompanied by the mark # in the upper corner. Further, in the case of the third octave, the bar (—) is illuminated at the lower left corner of the number. The fourth octave is indicated by the numbers without the bar. The fifth octave is indicated by the numbers accompanied by the bar at the upper left corner. In this manner, the respective octave displays are differentiated. The gate 21 is rendered conductive or nonconductive by a control signal g which is output from the control section 15.

The tone generator 13 receives the note code from the F register, the envelope data and timing signals from the M register, and the control signal from the control section 15 and produces a tone signal. The tone signal together with the rhythm signal from the rhythm generator 14 is supplied to an amplifier 22 in which the two signals are mixed and amplified. The amplified mixed signal is supplied to the sound producing section 4 and produced at a speaker 23.

Figure 6:
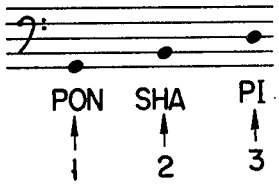
FIG. 6 is a view illustrating a musical scale for the basic arrangement of musical notes for rhythmic sounds.

The circuit arrangement for selecting a rhythm pattern will be described. A ROM (read-only memory) 25 stores 10 kinds of rhythm patterns, that is, march, waltz, four-four time, swing, rock-1, rock-2, bossa nova, samba, rhumba, and beguine. The march and waltz are, respectively, 2/4 time and $\frac{3}{4}$ time, and other rhythm patterns are played in 4/4 time. The 10 kinds of rhythm patterns as shown in FIGS. 7(A) to 7(J) are based on the notes G, B and D which are, respectively, characterized by sounds "pon", "sha" and "pi", as shown in FIG. 6. In this embodiment, the sounds "pon", "sha" and "pi" are designated by numbers 1, 2 and 3. Within the ROM 25, rhythm patterns are stored in which each sound is defined to have a duration corresponding to a quarter note, as shown in FIG. 3. The storage condition of the ROM 25 is described with reference to FIG. 3. The ROM 25 has ten row addresses 0 to 9 and 32 column addresses 0 to 31. The row addresses 0, 1, . . . , 9, respectively, correspond to the rhythm patterns, that is, march, waltz, . . . , beguine. The column addresses 0 to 7, 8 to 15, 16 to 23, and 24 to 31 are data areas which correspond to quarter notes. For example, in an area of the rhythm pattern of march, that is, a rhythm pattern in the 0th row address, data 1, 3, 1, and 3 which correspond to the quarter notes, respectively, are stored in the 0th, 8th, 16th and 24th column addresses. In other words, the rhythm pattern of march for two measures, that is, "pon" and "pi", and "pon" and "pi", is stored. Further, in the area of waltz, that is, the first row address, data 1, 3, and 3 which correspond to quarter notes, respectively, are stored in the 0th, 8th and 16th column addresses. In the same manner, for the second to 9 th row addresses which correspond to the rhythm patterns shown in FIG. 7C to 7J, data for one measure are stored in the corresponding column addresses.

The column addresses and the row addresses are specified by a row address section 26 and a column address counter 27, respectively. When one of the rhythm patterns shown in FIGS. 7A to 7J is selected by the RHY key 5c and one of the ten keys 0 to 9, one of the numeric data 0 to 9 which indicates the selected rhythm pattern and a read-in signal RD are input to the row address section 26. In response to the data and signal described above, the row address section 26 produces one of the row address data 0 to 9, so that one of the row addresses of the ROM 25 is selected. On the other hand, the column address counter 27 sequentially produces column address data which sequentially designate the column addresses 0 to 31 under the control of a rhythm control section 28.

The control counter 16 controls the rhythmic tempo. When the power switch is turned on, the numeric data "15" which is supplied from the control section 15 is automatically preset in the control counter 16. The preset data "15" in this manner increases by +1 every time the % key 5b is depressed, so that the counting value increases from 15 to 16, 17, . . . , 24, as shown in FIG. 5. On the other hand, the preset counting data "15" decreases by −1, in response to the signal −1, every time the ∨ key 5a is depressed so that the preset counting value "15" decreases to 14, 13, . . . , 6. The control counter 16 which has the reference counting value "15" counts up or down in the range of 6 to 24.

The counting value of the control counter 16 is supplied to an input end A of a coincidence circuit 29 and a subtraction circuit 30. A counting value of a counter 31 is supplied to an input end B of the coincidence circuit 29. The counter 31 counts clock signals having a period of 7.5 ms which are generated from the timing signal generator 12. The coincidence circuit 29 compares the counting values which are input from the input ends A and B thereof and detects whether or not the counting values coincide. If the counting values coincide, a binary coded signal "1" is supplied from the coincidence circuit 29 to the column address counter 27 and the rhythm control section 28 as the unitary incrementing signal. The coincidence signal is also supplied to the counter 31 as a reset signal so that the counter 31 is reset to be ready to initiate the subsequent counting operation.

The waltz rhythm pattern is only placed in 3/4 time, and the ROM 25 has the storage configuration in which data corresponding to four quarter notes are stored as the reference storage. The waltz rhythm pattern is thus stored in the column addresses 0 to 23 for one measure. On the other hand, other rhythm patterns are stored in the column addresses 0 to 31 for one measure. In order to differentiate the mode of operation for the waltz rhythm pattern from the modes of operation for the other rhythm patterns, the rhythm control section 28 is arranged. The detailed circuit configuration thereof will be described with reference to FIG. 4 later on.

The subtraction circuit 30 subtracts the counting value of the control counter 16 from the reference counting value "15" as described above. The subtraction results are supplied to the display section 3 through the gate 21. When the counting value of the control counter 16 is smaller than the reference counting value "15", that is, in the range of "14" to "6", the subtraction results are "1" to "9". As shown in FIG. 5, one of the positive values "1" to "9" is displayed at the display section 3. On the other hand, when the counting value of the control counter 15 is larger than the reference counting value "15", that is, in the range of "16" to "24", the subtraction results are "−1" to "−9". As shown in FIG. 5, one of the negative values "−1" to "−9" is displayed at the display section 3. When the negative value "−9" is displayed at the display section 3, the rhythmic tempo is the slowest (the period of the signal of 1440 ms corresponds to one quarter note). However, when the positive value "9" is displayed at the display section 3, the rhythmic tempo is the fastest (the period of the signal of 360 ms corresponds to one quarter note). The rhythmic tempo which is set in this manner may be visually checked at the display section 3 in such a manner that the displayed value is larger or smaller than the reference counting value and is positive or negative.

The detailed circuit arrangement of the row address section 26 and the rhythm control section 28 will be described with reference to FIG. 4. When rhythm pattern is specified by the [RHY] key 5c and one of the ten keys [0] to [9], the numeric data 0 to 9 is supplied to a buffer register 33. The read-in signal RD is supplied from the control section 15 to the buffer register 33. In this manner, the numeric data 0 to 9 specified by the key is read in the buffer register 33. The numeric data 0 to 9 which is stored in the buffer register 33 is input to a decoder 34 and output as the signal "1" through one of output lines l0 to l9. Therefore, the output data is supplied to the ROM 25 as the row address data.

An output from the output line l1 of the decoder 34, that is, the output line for the waltz rhythm pattern, is supplied to an AND gate 35 in the rhythm control section 28 as a gate control signal. The coincidence signal from the coincidence circuit 29 as shown in FIG. 2 is supplied to a 24-scale of counter 36 in which the coincidence signal is counted. A carry signal from the 24-scale of counter 36 is supplied to the AND gate 35. For this reason, when the AND gate 35 receives the carry signal, the AND gate 35 outputs the signal "1" and this signal is latched in a latch circuit 37. The 24-scale of counter 36 is reset by an output from the latch circuit 37, and the column address counter 27 is also reset. For example, when the specified rhythm pattern is the waltz rhythm pattern, column address counter 27 operates to access the column addresses 0 to 23 among the column addresses 0 to 31 of the ROM in correspondence with the counting operation of the column address counter 27. On the other hand, when a rhythm pattern other than the waltz rhythm pattern is specified, the AND gate 35 always outputs the signal "0" so that the latch circuit 37 also outputs the signal "0". Therefore, the column address counter 27 accesses the column addresses 0 to 31.

The mode of operation of the electronic portable musical instrument with a tone generating function of the above embodiment of the present invention will be described in the play mode. The mode changeover switch 9 is set to the position PL. In this changeover operation, the preset reference counting value "15" is supplied to the control counter 16 from the control section 15. Therefore, the reference counting value "15" is preset in the control counter 16. The reference counting value "15" which is preset in the control counter 16 in this manner is supplied to the subtraction circuit 30 in which the operation of 15-15 is performed. The subtraction result of "0" is supplied to the display section 3 through the gate 21. Thus, the data "0" is displayed at the display section. In this manner, the rhythmic tempo is visually set to the reference value.

Assume that the march rhythm pattern is selected and the rhythmic tempo is made faster than the reference tempo, that is, "10" as the counting value of the control counter 16. The march rhythm pattern is selected by depressing the [RHY] key 5*c* and the [0] key. Subsequently, the [V−] key 5*a* is depressed five times to set the rhythmic tempo. Therefore, when the [RHY] key 5*c* and the [0] key are depressed, the control section 15 supplies the numeric data "0" and the read-in signal RD (signal "1") to the buffer register 33 in the row address section 26. As a result, the numeric data "0" is stored in the buffer register 33 and the signal "1" is output from the output line l0 of the decoder 34. In this manner, the row address data "0" which corresponds to the area in which the march rhythm pattern is stored in the ROM 25 is supplied to the ROM 25. Further, when the [V−] key 5*a* is depressed five times, the unitary decrementing signal is supplied five times from the key input section 2 to the control counter 16. Therefore, the counting value of the control counter 16 is set to "10". As a result, the value which indicates the rhythmic tempo changes from "1" to "5" at the display section 3. The value "5" is finally displayed at the display section 3. The counting value "10" of the control counter 16 is also supplied to the input end A of the coincidence circuit 29. The counter 31 counts the clock signals having a period of 7.5 ms which are generated from the timing signal generator 12. The counting value of the counter 31 is supplied to the input end B of the coincidence circuit 29. The coincidence circuit 29 compares the counting values to determine whether or not they coincide. Every time the counting value of the counter 31 becomes "10", the coincidence signal is outputted from the coincidence circuit 29. The coincidence signal is supplied to the rhythm generator 14, the rhythm control section 28 and the counter 31. Therefore, in the rhythm control section 28, the coincidence signal is supplied to the 24-scale of counter 36 and counted. However, since the march rhythm pattern is selected, the AND gate 35 is constantly rendered nonconductive, so that the column addresses 0 to 31 are sequentially specified by the counting value of the column address counter 27. In this manner, the data 1, 3, 1 and 3 which, respectively, correspond to the sounds "pon", "pi", "pon", and "pi" are read out from the 0th, 8th 16th and 24th column addresses. The readout data is supplied to the rhythm generator 14. The counter 31 is reset every time the coincidence signal is input thereto, initiating the counting operation. Further, in the rhythm generator 14, when the data "1" is read out from the ROM 25, the rhythmic sound corresponding to the note G is set to the displayed data 5 with the tempo of 600 ms and produced from the sound producing section 4.

When the rhythmic sound corresponding to the note G in accordance with data 1 is completed, the column address counter 27 sequentially increments and data 3 is read out from the 8th column address of the ROM 25, so that the rhymic sound "pi" corresponding to the note B is produced. In the same manner as described above, data 1 and 3 are read out from the 16th and 24th column addresses of the ROM 25 so that the rhythmic sounds corresponding to the notes G and B are produced at the speaker 23. When the production of the rhythmic sound of the note B corresponding to the data 3 is completed, the column address counter 27 is reset to the initial counting value, that is, "0". The 0th column address is specified, so that the rhythmic sound "pon" is produced at the speaker 23. In this manner, the rhythmic sounds "pon", "pi", "pon", "pi", . . . for the march rhythm pattern (2/4 time) are sequentially produced with the predetermined rhythmic tempo. Further, when the pitch designation key is operated with the rhythmic sounds, the tone corresponding to the pitch of the pitch designation key is produced in the tone generator 13 and supplied to the amplifier 22, accomplishing the melody performance with the predetermined rhythm pattern. For the other rhythm patterns from four-four time to beguine which, are respectively, stored in the second to 9th row addresses of the ROM 25, the same mode of operation as in the march rhythm pattern is repeated to produce the respective rhythmic sounds.

The mode of operation for producing the rhythmic sounds of the waltz rhythm pattern which is stored in the first row address of the ROM 25 will be described. The RHY key 5*c* and the 1 key are sequentially depressed. The control section 15 supplies the numeric data "1" corresponding to the first row address to the buffer register 33. When the rhythmic tempo is to be made slow, that is, "20" of the counting value of the control counter 16, the % key 5*b* is depressed five times to change the reference counting value from "15" to "20". The specified tempo is displayed as "—5" at the display section 3.

On the other hand, the numeric data "1" which is stored in the buffer register 33 is decoded at the decoder 34 and is supplied from the output line l1 of the decoder 34 as the signal "1". As a result, the row address data "1" is supplied to the ROM 25 so that the waltz rhythm pattern data may be read out. Further, the AND gate 35 is rendered conductive by the signal "1" from the output line l1 of the decoder 34. The column addresses of the ROM 25 are accessed in acccordance with the counting operation of the 24-scale of counter 36. That is, the counting value "20" is set in the control counter 16. Therefore, every time the counting value of the counter 31 becomes "20", the coincidence signal is supplied from the coincidence circuit 29 to the 24-scale of counter 36. The counting value changes from "0" to "23" in the 24-scale of counter 36. The counting value of the column address counter 27 correspondingly changes from "0" to "23" so that the column addresses 0 to 23 of the ROM 25 are sequentially accessed. Therefore, the data 1, 3, 3 which corresponds to the waltz rhythm pattern which is stored in the 0th, 8th and 16th column addresses are sequentially read out and supplied to the rhythm generator 14. Therefore, the waltz rhythmic sounds comprising the sounds "pon", "pi" and "pi" are produced with the predetermined rhythmic tempo at the sound producing section 4. When the carry signal is supplied from the 24-scale of counter 36, the AND gate 35 outputs the signal "1" which is, in turn, latched in the latch circuit 37. The column address counter 27 and the 24-scale of counter 36 are simultaneously reset. The column addresses are then accessed by the column address counter 27 which is controlled by the 24-scale of counter 36 again. In this manner, the address access control of the ROM 25 for producing the waltz rhythmic sounds is different from that for producing the rhythmic sounds of the other rhythm patterns. For the waltz rhythm pattern, the column addresses 0 to 23 are used instead of the column addresses 0 to 31.

In the above embodiment, the present invention is applied to an electronic portable calculator with a tone generating function. However, the present invention is not limited to this, but may be extended to other electronic musical instruments such as an electronic organ or other electronic equipment with a tone generating function. The number and kinds of rhythms are not limited to those of the electronic portable calculator with a tone generating function according to the embodiment of the present invention. The number and kinds of rhythms may be arbitrarily determined as needed.

What is claimed is:

1. Electronic equipment having a rhythm sound generating function, comprising:

memory means for storing a plurality of rhythm pattern data items;

a keyboard provided at a key input section, for specifying note data at a performance mode;

mode changing means provided at said key input section for changing the mode of said keyboard from said performance mode to a rhythm specifying mode;

means for enabling said keyboard to specify, upon operation of said keyboard, a rhythm pattern data item among said plurality of rhythm pattern data items at said rhythm specifying mode;

read-out control means coupled to said memory means for reading out said specified rhythm pattern data item from said memory means responsive to operation of said keyboard; and rhythm sound generating means coupled to said memory means for generating a rhythm sound according to said specified rhythm pattern data item read out from said memory means.

2. Electronic equipment according to claim 1, wherein said mode changing means includes means for changing the mode of said keyboard from said performance mode or said rhythm specifying mode to a calculating mode, and said equipment further includes:

means for enabling said keyboard to input numeric data and operation data at said calculating mode; and operating means for performing four fundamental arithmetic operations according to said numeric data and operation data input via said keyboard at said calculating mode.

3. Electronic equipment having a rhythm sound generating function, comprising:

memory means for storing a plurality of rhythm pattern data items, each corresponding to a respective peculiar number;

numeric keys which are operable for inputting numeric data at a performance mode, which numeric data is operated on by the electronic equipment to produce a numeric result;

means coupled to said numeric keys for enabling said numeric keys to input a peculiar number at said performance mode so as to specify a corresponding rhythm pattern data item stored in said memory means;

read-out control means coupled to said memory means and responsive to said peculiar number input by operating said numeric keys, for reading out a specified rhythm pattern data item from said memory means;

rhythm sound generating means coupled to said memory means for generating a rhythm sound according to said specified rhythm pattern data item read from said memory means;

mode changing means for changing the mode of said numeric keys from said performance mode to a calculating mode;

means coupled to said numeric keys for enabling said numeric keys to input numeric data at said calculating mode;

function keys for specifying the type of arithmetic operations including at least one of addition, subtraction, multiplication and division; and operating means coupled to said numeric keys and to said function keys for performing arithmetic operations according to said numeric data and said specified type of arithmetic operations;

said arithmetic operations being selectively performed on said numeric data input by operation of said numeric keys and said function keys.

4. Electronic equipment having a rhythm generating function, comprising:

memory means for storing a plurality of rhythm pattern data items each corresponding to a peculiar number;

numeric keys which are operable for inputting numeric data; means coupled to said numeric keys for enabling said numeric keys to input a peculiar number so as to specify the corresponding rhythm pattern data item stored in said memory means;

read-out means coupled to said memory means and responsive to said peculiar number input by operating said numeric keys for reading but a specified rhythm pattern data item from said memory means;

rhythm sound generating means coupled to said memory means for generating a rhythm sound according to said specified rhythm pattern data item read from said memory means;

operating means for performing arithmetic operations including at least addition, subtraction, multiplication and division;

function keys for specifying arithmetic operations to be performed by operating said numeric keys to input numeric data, said arithmetic operations being selectively performed on the numeric data input by operating said numeric keys, in response to the operation of said function keys; and tempo setting keys for setting a tempo at which the rhythm pattern data item is read from said memory means by said read-out means.

5. Electronic equipment according to claim 4, further comprising display means for displaying a number designating the tempo set by operating said tempo setting keys.

* * * * *